United States Patent [19]

Ooms

[11] 4,413,205

[45] Nov. 1, 1983

[54] HALOGEN INCANDESCENT LAMP WITH INTERNAL CURRENT CONDUCTORS OF TUNGSTEN-RHENIUM ALLOY

[75] Inventor: Leo F. M. Ooms, Eindhoven, Netherlands

[73] Assignee: U.S. Philips Corporation, New York, N.Y.

[21] Appl. No.: 266,574

[22] Filed: May 22, 1981

[30] Foreign Application Priority Data

Jun. 26, 1980 [NL] Netherlands ..... 8003698

[51] Int. Cl.[3] ..... H01K 1/20

[52] U.S. Cl. ..... 313/579

[58] Field of Search ..... 313/218, 222, 579, 633

[56] References Cited

U.S. PATENT DOCUMENTS 3,412,277 11/1968 Thouret ..... 313/222

3,443,143 5/1969 Koo ..... 313/218 X 3,470,410 9/1969 Patsch ..... 313/42 X 3,502,931 3/1970 Mosby ..... 313/222 X

*Primary Examiner*—Palmer C. Demeo

*Attorney, Agent, or Firm*—Robert S. Smith

[57] ABSTRACT

In halogen incandescent lamps having a filament 5 substantially of tungsten and a filling comprising bromine and an inert gas, a specific attack of internal current conductors 6 consisting substantially of tungsten occurs within the temperature range from 600° to 1300° C., which results in the formation of pits or craters in these internal current conductors 6.

In order to obviate such attack of internal current conductors 6, the internal current conductors 6 consist at least at their surface of a tungsten containing at least 0.1% by weight of rhenium.

4 Claims, 3 Drawing Figures

Figure 1:
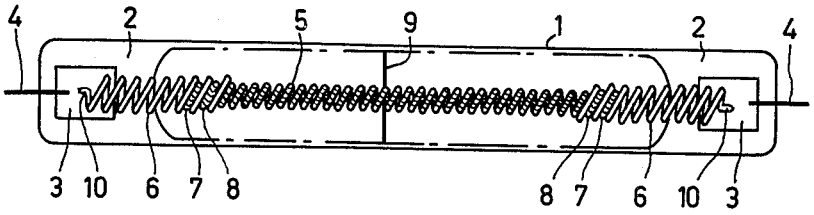

HALOGEN INCANDESCENT LAMP WITH INTERNAL CURRENT CONDUCTORS OF TUNGSTEN-RHENIUM ALLOY

The invention relates to a halogen incandescent lamp having a vacuum-tight sealed glass lamp envelope which has a filling comprising bromine and an inert gas, and i which lamp a filament substantially of tungsten is connected to internal current conductors consisting substantially of tungsten which extend inwardly from the wall of the lamp envelope.

U.S. Pat. No. 3,470,410 describes such a lamp, and states that the current conductors which supply current to the filament inside the lamp envelope, can be attacked by bromine in such a manner that they break and the lamp extinguishes. This Patent Specification proposes a solution to this problem which consists of winding tungsten wire around the current conductors so that a gradual temperature drop is created along the length of said current conductors.

The attack results in a transport of tungsten from locations at a lower to locations at a higher temperature. When a current conductor consists of a helically wound wire, tungsten is removed from comparatively cold turns and is deposited on comparatively warm turns situated closer to the filament.

It has been found that in addition to this attack in which a turn—or generally a place at a given temperature—is attacked homogeneously, a second form of attack occurs. This attack results in the formation of wells or craters which are distributed over an area where during operation the temperature is between approximately 600° C. and 1300° C. This second form of attack will hereinafter be referred to as well formation.

It is very remarkable that although well formation occurs in a large temperature range which is sharply bounded at its upper end, well formation nevertheless occurs very locally. When a crater has been formed at a certain place in a current conductor, the cross-section of the current conductor at the area of the crater usually is entirely perfect diametrically opposite to the crater although the temperature at that area is the same as the temperature at the place where the crater has been formed.

Well formation is a serious problem in particular in lamps having a long designed life, since attack can have progressed already after approximately 100 hours in operation to such an extent that a crater having a depth of, for example, 80% of the diameter of the current conductor has been formed, and the current conductor breaks or fuses.

It is the object of the invention to provide halogen incandescent lamps in which well-shaped attack of the internal current conductors is effectively suppressed.

The invention provides a halogen incandescent lamp having a vacuum-tight sealed glass lamp envelope which has a filling comprising bromine and an inert gas, and in which lamp a tungsten filament is connected to internal current conductors consisting substantially of tungsten and which extend inwardly from the wall of the lamp envelope, characterized in that the internal current conductors consist at least at their surface of tungsten containing at least 0.1% by weight of rhenium.

It has been found that rhenium is such a small quantity drastically reduces well formation. With 1% by weight of rhenium the well formation is only very superficial, while with 3% by weight of rhenium no well formation at all was observed. No well formation was found for tungsten with 27% by weight of rhenium and for pure rhenium. Since rhenium is very expensive, tungsten rhenium will be chosen with the lowest rhenium content which in the given circumstances gives a result which is satisfactory for practical applications, that is to say suppresses well formation in such a manner that said attack is not the cause of the end of the lamp life. In by far most types of lamps, a rhenium content of from 1 to 3% by weight will be chosen for that reason. When the internal current conductors are thick as compared with the diameter of the wire from which the filament is wound, the halogen concentration in the lamp during operation is low or the designed life of the lamp is short, a rhenium content of 0.1% by weight or higher may be chosen.

The mechanism underlying the well formation has remained unexplained. It was not possible to show that well formation was caused by impurities such as sulphur, iron, potassium, sodium, carbon, silicon which occur in tungsten used for filaments. No influence whatsoever on well formation was found of a large number of elements including zirconium, tantalum, niobium, molybdenum, platinum and osmium, osmiun being chemically closely related to rhenium. It is therefore the more surprising that very small quantities of rhenium have proved to be effective. Just as the mechanism of well formation has remained unexplained, so the way in which rhenium inhibits well formation has remained unknown. It has been found that rhenium must be present at the surface to be protected. That rhenium has no effect when it is only present in a lamp at, on, or in a component which is not an internal current conductor, has been shown in an experiment in which a piece of rhenium wire had been welded to an internal current conductor of rhenium-free tungsten and in which said internal current conductor nevertheless showed well formation beside the weld.

A lamp according to the invention may be constructed in various forms. The internal current conductors may both (or each) project outside the lamp envelope through a (respective) vacuum-tight seal in the wall of the lamp envelope, but on the other hand, they may be welded to a respective metal foil incorporated in said seal(s) to which a respective external current conductor projecting from the lamp envelope has also been welded.

The lamp envelope may consist of a hard glass, for example, an alkali metal alumino-borosilicate glass, or of a glass having a higher $SiO_2$ content, for example, a content of 95% by weight or more of $SiO_2$, for example, quartz glass.

A large variety of forms of internal current conductors may be used in the lamps. For example, wires wound helically entirely or partly may be used which may each be screwed with one end around or into a respective end of the filament. On the other hand, straight wires may be used around which a helical wire is wound, for example, at their end projecting into the lamp envelope so as to be able to screw them with said end into a respective end of the filament. In this latter construction the enveloping helical wire may comprise rhenium but since it has no supporting function and in addition during operation is at a temperature of more than 1300° C. at which well formation does not occur, said enveloping helical wire may just as well consist of rhenium-free tungsten.

In another embodiment the internal current conductor consists of a helically wound wire which at least at its end projecting inside the lamp envelope, is provided around a limb of the filament.

The internal current conductors may consist of a solid tungsten-rhenium alloy, or of a tungsten core on which rhenium has been provided, for example, by chemical vapour deposition. The rhenium may then be diffused into the tungsten. Another possibility of manufacturing the tungsten-rhenium alloy is by ion implantation of rhenium in tungsten.

A lamp according to the invention can be manufactured and be provided with its gas filling in a conventional manner. The bromine may be added elemental form, or in the form of hydrogen bromide or a brominated hydrocarbon, for example, methylene bromide, which decomposes during the first operation of the lamp and forms hydrogen bromide, which during operation of the lamp dissociates at least partly.

It is to be noted that vacuum lamps and lamps which are filled exclusively with inert gas are disclosed in British Patent Specification 1,053,020, in which lamps the filament consists of a tungsten rhenium alloy. No solution to the problem of well formation can be derived from said Patent Specification: not only do the known lamps contain no bromine, but no mention is made of the nature of the internal current conductors.

It is furthermore to be noted that an iodine lamp is disclosed in U.S. Pat. No. 3,392,299 in which tungsten/-rhenium supports are provided on a tungsten/rhenium filament between its ends. This Patent also does not state anything about the nature of the internal current conductors inserted in the filament. Since in addition well formation does not occur in lamps having a tungsten-iodine cycle, as it does not in vacuum lamps or in lamps filled only with an inert gas, a solution to the problem of well formation cannot be derived from this Patent either.

A lamp according to the invention may be used inter alia as a floodlight lamp, an infrared heat lamp, or as a photographic lamp.

Figure 2:
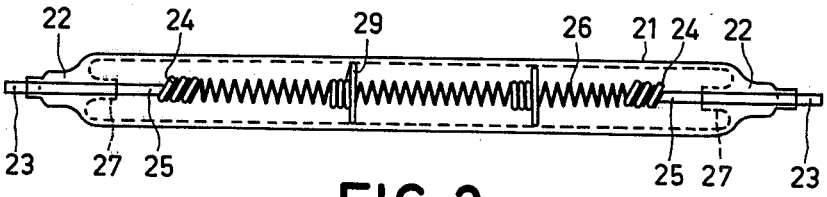
Figure 3:
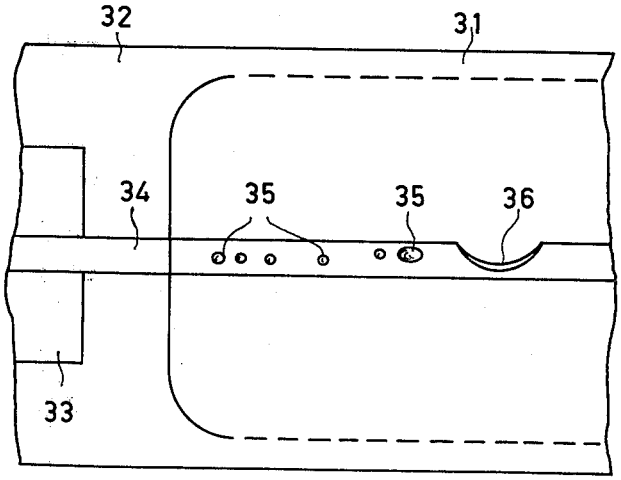

Two embodiments of lamps according to the invention are shown in FIGS. 1 and 2 of the drawing. In the drawing FIG. 1 is a diagrammatic side elevation of a lamp according to the invention;

FIG. 2 is a diagrammatic side-elevation of another lamp according to the invention, and FIG. 3 is a detail of part of a conventional lamp which is shown considerably enlarged.

The lamp shown in FIG. 1 has a quartz glass lamp envelope 1 which is sealed in a vacuum-tight manner by means of pinches 2 in which molybdenum foils 3 are incorporated. External current conductors 4 are welded to the molybdenum foils. A coiled coil filament 5 of tungsten is accommodated in the lamp envelope, and the outermost turns 7 and 8 of the filament 5 engage helically wound internal current conductors 6 of a tungsten-rhenium alloy containing 1% by weight of rhenium, these conductors 6 having a wire diameter of 500 μm. The filament 5 is centered between its ends by a support 9 of tungsten wire. A straight end 10 of each internal current conductors 6 is welded to the respective molybdenum foil 3. The lamp is filled with 2.5 bar of Ar to which 0.3% by volume of $CH_2Br_2$ has been added, which decomposes when the lamp is first ignited and gives off hydrogen bromide. The lamp consumed a power of 500 W. At the end of the lamp life, the filament 5 fused. The internal current conductors 6 were then still intact and showed only a very slight superficial well formation.

The lamp shown in FIG. 2 has a hard glass lamp envelope 21 with vacuum-tight seals 22 through which seals 800 μm thick wire 23 of tungsten containing 0.1% by weight of rhenium which inside the lamp form internal current conductors 25 extending to the filament 26 which has tungsten-rhenium alloy supporting members 29. Each internal conductor 25 has tungsten wire turns 24 which are in engagement with the filament 26. The wires 23 are coated over a part of their length with a layer of hard glass 27 on which the vacuum-tight seal 22 of the lamp envelope 21 are made. The lamp is filled with Ar to which 0.6% by volume of HBr has been added.

The lamp consumed a power of 1000 W. The end of life was reached by fracture of the filament some time after the designed number of hours in operation had elapsed. The internal current conductors 25 were then still intact. In comparison with similar lamps with rhenium-free internal current conductors, they showed a very strongly reduced extent of well formation.

Reference numeral 31 in FIG. 3 denotes a lamp envelope of a 220 V 1500 W floodlight lamp having a pinch seal 32 in which a molybdenum foil 33 is incorporated, to which foil 33 an internal current conductor 34 of tungsten is welded. Tungsten wire not shown having a diameter of 235 μm was wound around the free end of said current conductor 34, the turns of which tungsten wire engaged the filament (not shown) of the lamp. FIG. 3 shows the condition of the internal current conductor 34 after 100 hours in operation at design voltage, the lamp filling consisting of 2.5 bar (at 300° K.) of Ar, to which 0.6% by volume of HBr had been added. In addition to a series of small shallow wells 35, one large and very deep well 36 is visible. Diametrically opposite to the well 36, no attack is visible. At the area of said well 36, the thickness of the internal current conductor 34 has been reduced from 500 to approximately 100 μm, that is to say has become much smaller than the diameter of the filament of the lamp (250 μm) so that the possibility of fracture or fusing has become large. A similar lamp having internal current conductors consisting of a tungsten-rhenium alloy containing 3% by weight of rhenium had internal current conductors which were still completely undamaged after the lamp had been in operation for 2000 hours.

What is claimed is:

1. A halogen incandescent lamp having a vacuum-tight sealed glass lamp envelope which has a filling comprising bromine and an inert gas, and in which lamp a filament substantially of tungsten is connected to internal current conductors consisting substantially of tungsten and which extend inwardly from the wall of the lamp envelope, the internal current conductors consisting at least at their surface of tungsten containing at least 0.1% by weight of rhenium.

2. A halogen incandescent lamp as claimed in claim 1, wherein the tungsten contains from 1 to 3% by weight of rhenium.

3. A halogen incandescent lamp having a vacuum-tight sealed glass lamp envelope which has a filling comprising bromine and an inert gas, and in which lamp a filament substantially of tungsten is connected to internal current conductors consisting substantially of tungsten and which extend inwardly from the wall of the lamp envelope, the internal current conductors consisting at least at their surface of a tungsten alloy having a rhenium content of approximately 0.1% by weight.

4. A halogen incandescent lamp having a vacuum-tight sealed glass lamp envelope which has a filling comprising bromine and an inert gas, and in which lamp a filament substantially of tungsten is connected to internal current conductors consisting substantially of tungsten and which extend inwardly from the wall of the lamp envelope, the internal current conductors consisting at least at their surface of a tungsten alloy having a rhenium content of approximately 1.0% by weight.

* * * * *